US006659692B1

(12) United States Patent
May

(10) Patent No.: US 6,659,692 B1
(45) Date of Patent: Dec. 9, 2003

(54) APPARATUS AND METHOD FOR SUPPORTING A STRUCTURE WITH A PIER AND HELIX

(76) Inventor: Donald May, 25662 S. Brentwood Dr., Sun Lakes, AZ (US) 85248

( * ) Notice: Subject to any disclaimer, the term of this patent is extended or adjusted under 35 U.S.C. 154(b) by 0 days.

(21) Appl. No.: 10/200,768

(22) Filed: Jul. 22, 2002

(51) Int. Cl.[7] ..... E02D 11/00
(52) U.S. Cl. ..... 405/232; 405/230; 405/244
(58) Field of Search ..... 405/230, 231, 405/232, 244, 252.1; 248/156, 679

(56) References Cited

U.S. PATENT DOCUMENTS

| | | | | | |
|---|---|---|---|---|---|
| 4,070,867 | A | | 1/1978 | Cassidy | 405/231 |
| 4,634,319 | A | | 1/1987 | May | 405/230 |
| 4,667,746 | A | | 5/1987 | Moraly | 173/89 |
| 4,673,315 | A | | 6/1987 | Shaw et al. | 405/230 |
| 4,678,373 | A | * | 7/1987 | Langenbach, Jr. | 405/230 |
| 4,733,994 | A | | 3/1988 | Simanjuntak | 405/244 |
| 4,800,700 | A | | 1/1989 | May | 52/741 |
| 4,854,782 | A | | 8/1989 | May | 405/230 |
| 4,925,345 | A | | 5/1990 | McCown et al. | 405/232 |
| 5,011,336 | A | | 4/1991 | Hamilton et al. | 405/230 |
| 5,013,190 | A | | 5/1991 | Green | 405/230 |
| 5,123,209 | A | | 6/1992 | Nally | 405/230 |
| 5,154,539 | A | | 10/1992 | McCown et al. | 405/230 |
| 5,171,107 | A | * | 12/1992 | Hamilton et al. | 405/230 |
| 5,205,673 | A | | 4/1993 | Bolin et al. | 405/230 |
| 5,213,448 | A | * | 5/1993 | Seider et al. | 405/230 |
| 5,234,287 | A | | 8/1993 | Rippe, Jr. | 405/230 |
| 5,246,311 | A | | 9/1993 | West et al. | 405/230 |
| 5,253,958 | A | | 10/1993 | Bellemare | 405/232 |
| 5,288,175 | A | | 2/1994 | Knight | 405/230 |
| 5,310,287 | A | | 5/1994 | Arentsen | 405/246 |
| 5,336,021 | A | * | 8/1994 | Freeman, III | 405/230 |
| 5,492,437 | A | | 2/1996 | Ortiz | 405/230 |
| 5,658,099 | A | * | 8/1997 | Pienaar et al. | 405/288 |
| 5,800,094 | A | * | 9/1998 | Jones | 405/230 |
| 5,980,162 | A | | 11/1999 | McCown | 405/244 |
| 6,079,905 | A | * | 6/2000 | Ruiz et al. | 405/230 |
| 6,193,442 | B1 | | 2/2001 | May | 405/232 |
| 6,368,022 | B1 | | 4/2002 | Zingerman | 405/230 |
| 6,368,023 | B1 | | 4/2002 | Lau | 405/232 |

* cited by examiner

*Primary Examiner*—Heather Shackelford
*Assistant Examiner*—Lisa M. Saldano
(74) *Attorney, Agent, or Firm*—Steptoe & Johnson LLP; Tyson York Winarski

(57) ABSTRACT

A helical pier assembly having a helix mounted on the end of a pier shaft. A pier-cap stabilizer is driven with force down over the pier shaft until the top of the pier meets a stop pin secured in the pier cap. A platform screw jack is placed op top of the pier cap under the footing or foundation. The jack screws are extended down onto the pier cap until the platform jack comes into contact with the bottom of the footing or foundation. The jack screws are turned until the required support contact is achieved between the pier cap stabilizer and the footing or foundation. A bag of concrete is placed between the screw jack and the bottom of the footing to prepare the footing.

23 Claims, 11 Drawing Sheets

APPARATUS AND METHOD FOR SUPPORTING A STRUCTURE WITH A PIER AND HELIX

TECHNICAL FIELD OF THE INVENTION

The present invention relates to the field of structural pier devices designed to support structural foundations and footings in order to counter the effects of settling and ground movement.

BACKGROUND OF THE INVENTION

Many structures, such as residential homes and low rise buildings, are constructed on foundations that are not in direct contact with a stable load bearing underground stratum, such as, for example, bedrock. These foundations are typically concrete slabs or a footing upon which a foundation wall rests. The footing is generally wider than the foundation wall in order to distribute the structure's weight over a greater surface area of load bearing earth. Therefore, the stability of these structures depends upon the stability of the ground underneath or supporting the foundation. With time, the stability of the underlying soil may change for many reasons, such as changes in the water table, soil compaction, ground movement, or the like. When the stability of the support ground changes, many times the foundation will move or settle. The settling of a structure's foundation can cause structural damage reducing the value of the structure or total property.

For instance, structural settling can cause cracks in foundation walls. Unsightly cracks can appear on the interior or exterior of building walls and floors. In addition, settling can shift the structure causing windows and doors to operate poorly. Inventors have recognized the foundation-settling problem and have developed various devices and methods to correct its effects.

One common device and method to correct foundation settling consists of employing hydraulic jacks in conjunction with piers to lift the foundation. Piers, also known as piles or pilings, are driven into the ground by hydraulic mechanisms until the pier reaches bedrock or until the pier's frictional resistance equals the compression weight of the structure. Once these piers are secured in a stable underground stratum or several stable underground strata, further lifting by the hydraulic jacks raises the level of the foundation. When the foundation is raised to the desired level, the piers are permanently secured to the foundation. The hydraulic jacks are then removed. This method of correcting the level of a foundation generally requires the excavation of a hole adjacent to or underneath the foundation in order to position and operate the lifting equipment.

Steel piers are well known and exist in many varieties. One common type of a pier is a straight steel pier that is driven down until it reaches bedrock or stable soil weight bearing layer. These straight steel piers are rammed straight down into the ground. Another style of pier known to the art is a helical pier. On the end of a long pier shaft is a large helix. This helix distributes the weight of the pier over a larger surface area of soil making it a highly desirable pier structure to use. Unlike straight piers that are driven straight through the earth, it is necessary to screw the helical piers into the earth through rotating the pier shaft.

The use of a screwed-in-helix with a steel shaft is very common in supporting the footings and foundations of structures. For instance, a plurality of helical piers are typically installed at structurally strategic positions along the footing or foundation of a structure. These piers are then anchored together and interconnected by setting them all within reinforced concrete. In other instances, a plurality of steel piers are installed at various angles with respect to the building. These piers are then tied together to the footing or foundation with re-enforcing bars or pin connections. These bars or pin connections are then encapsulated within concrete.

When the helical steel pier is installed to support a footing or foundation of an existing structure, the pier is installed at an angle with respect to the building in order to accommodate the mechanical equipment necessary to screw the helical pier into the earth. This angle causes the building to place a lateral force on the pier resulting in an eccentric loading. When the top of the pier extends above the bottom of the footing or foundation and the load is carried on the top of the pier shaft, the eccentricity of the load is unnecessarily extended and weakens the load bearing capacity of the pier.

A helical pier shaft is disclosed in U.S. Pat. No. 5,171,107. This patent teaches a method wherein a helical anchor is screwed down into the earth. Importantly, this patent teaches that the helical anchor extends above the footing of the building. In addition, this patent teaches that the helical anchor extends off to the side of the footing creating an eccentric loading condition. Ideally, only vertical forces will exist in the final helical pier and foundation structure. However, because the pier taught by this patent extends to the side of the footing, the foundation places a lateral force against the pier that tends to push the pier outwardly. Through this lateral force that causes an eccentric loading, the building shifts laterally over the pier until the pier no longer supports the vertical weight of the building. Consequently the pier's effectiveness is neutralized and the building subsides. It is highly desirable to design a pier that reduces the degree of this eccentric loading to prevent the lateral movement of the helical pier and footing or foundation.

Further, U.S. Pat. No. 5,171,107 teaches that a bracket assembly is needed to secure the helical pier to the footing. This bracket assembly requires a costly preparation of the footing. The bottom surface of building footers is typically very rough due to the manner in constructing the footer. In order to attach the bracket for the helical pier to the bottom surface of the footer, it is necessary to prepare the footer. Otherwise, if the pier bracket is placed against the uneven surface, stress fractures will occur in the footing damaging the structure and retarding the ability of the helical pier to support the building.

Preparing the footer is a labor intensive process that requires the use of concrete chippers or saws. These mechanical devices are used by laborers to smooth the bottom surface of the footer. It is therefore highly desirable to develop a pier system that can eliminate this costly and time consuming process. In addition, the bracket assembly is a complicated piece of equipment that greatly adds to the cost of the helical pier.

There are other foundation support technologies known to the art. For instance, Ortiz, U.S. Pat. No. 5,492,437, teaches a lifting device that is made of one or more power cylinders that are pivotally linked to a pier and to a foundation bracket assembly. The pivotal linkage results in self-alignment between the longitudinal axis of the pier and the axis along which compressive pressure is applied to the pier. This patent requires the pier to be lifted above the bracket in order to position the pier within the bracket.

West et al., U.S. Pat. No. 5,246,311, discloses a pier driver having a pair of opposing first upright members straddling a pier support. The upright members are temporarily attached to the foundation and a pair of opposing first foot members operably extending beneath the foundation. A plurality of secondary lifting mechanisms, in cooperation with the piers previously installed by the pier driver, are adapted to lift the foundation. The pier supports of the pier heads are then permanently fixed to the respective piers with a bracket to provide permanent support to the foundation. This patent requires the pier to be lifted above the bracket in order to position the pier within the bracket.

Bellemare, U.S. Pat. No. 5,253,958, describes a device for driving stakes into the ground, particularly a foundation stake used for stabilizing, raising, and shoring foundations. The device disclosed has two rods secured to two hydraulic jacks, the hydraulic jacks and the rods being parallel to the driving axis of the stake. A driving member with a hammering head is provided to drive the stake into the ground. This patent requires that the pier to be lifted above the bracket in order to position the pier within the bracket.

Despite these known designs, there is a very distinct need in the art to develop an improved pier design that reduces the amount of eccentric loading on the pier to reduce the lateral movement of the footing or foundation. Still further, there is a great need in the art to develop a pier that eliminates the costly bracket assembly.

SUMMARY OF THE INVENTION

The present invention is a helical pier that supports a footing or foundation of a residential or commercial building. The helical pier of the present invention has a helix secured to the end of a pier shaft. An area of earth is excavated around and beneath the footing or foundation of the structure for the helical pier. The pier is inserted in to the excavated area with the shaft extending through a notch formed in the foundation. Mechanical devices are then used to apply torque and drive the shaft into the ground. The pier is driven to a level where there is sufficient compression in the soil to support the distributed load of the structure.

A pier-cap stabilizer is driven with force down over the pier shaft until the top of the pier meets a stop pin secured in the pier cap. A platform screw jack is placed op top of the pier cap under the footing or foundation. The jack screws are extended down onto the pier cap until the required support contact is achieved between the pier cap stabilizer and the footing or foundation.

The bottom surface of building footers is typically very rough. In order to attach a helical pier to the bottom surface of the footer, it is necessary to prepare the footer. The present invention prepares the footer by inserting a flexible bag filled with unhardened concrete between the top surface of the screw jack platform and the bottom surface of the footer. The unhardened concrete fills in the voids and contours on the bottom surface of the footer creating a structurally sound flat surface.

The pier-cap stabilizer includes a vertical stabilizing section that attaches to the side of the footing. With the jacks screws extended and the vertical stabilizing section attached, the installation of the helical pier is complete if the structure is at a desired height and level with respect to the ground. However, it is commonly necessary to lift the structure in height on the piers. This lifting is achieved through placing a hydraulic power ram between the top of the pier cap and under the platform screw jack. As the structure is raised by the hydraulic ram, the jack screws are turned down on to the top of the pier cap. When the screws are extended fully, the hydraulic ram is then removed and installation is complete.

DETAILED DESCRIPTION OF A PREFERRED EMBODIMENT

Figure 1:
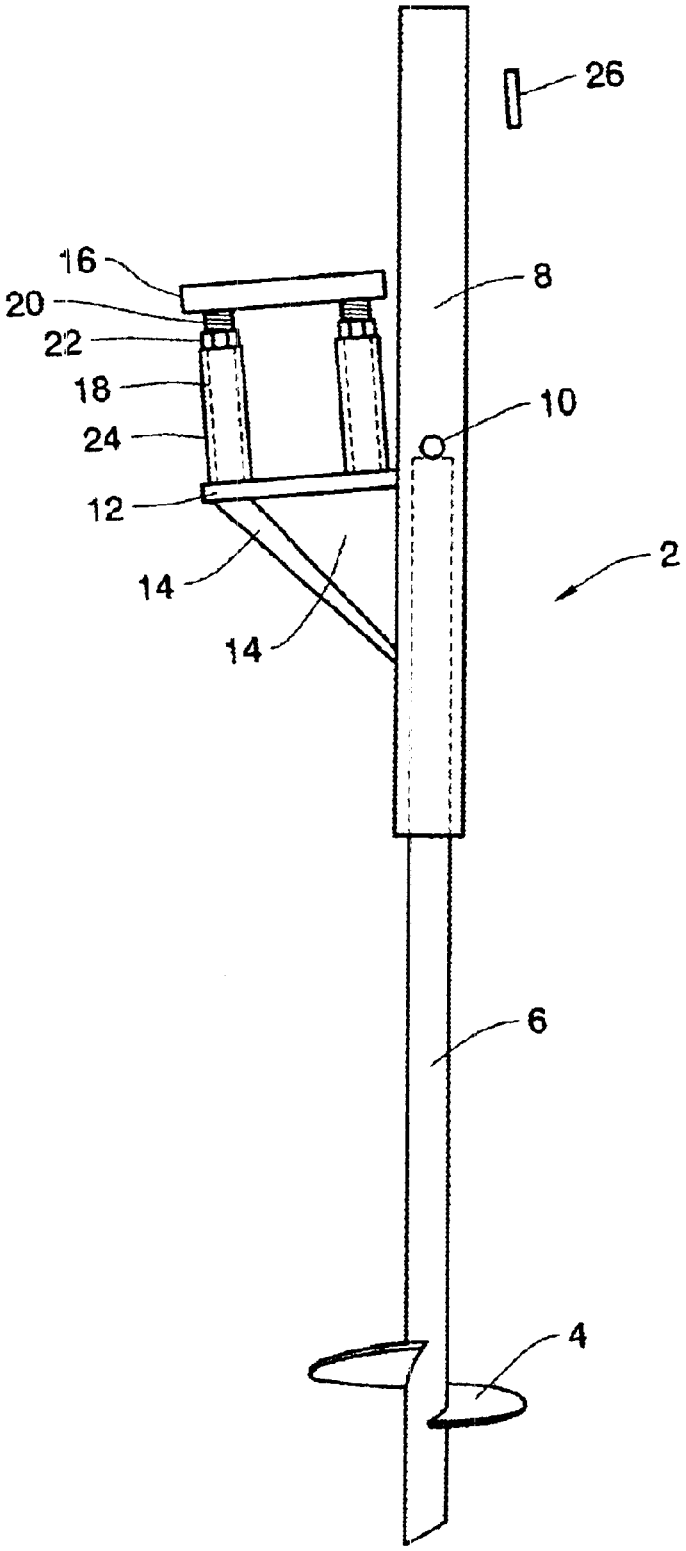
FIG. 1 depicts a preferred present embodiment of the invention.

Referring to the figures by characters of reference, FIG. 1 depicts a preferred present embodiment of the invention. The two piece helical pier assembly 2 has a helix 4 at the bottom of a pier shaft 6. Helix 4 distributes the downward pressure from a building over an area of earth. On top of the pier shaft 6 is a pier cap stabilizer 8. A bolt 10, commonly referred to as a pin secured to pier cap stabilizer 8 prevents pier cap stabilizer 8 from sliding down along pier shaft 6.

A shelf 12 is secured to pier cap stabilizer 8 using shelf gussets 14. Shelf 12 provides support for a jack screw assembly 15. Jack screw assembly 15 is made of a jack platform 16 and two or more jack screws 18. Jack screws 18 have a threaded shaft 20, nuts 22, and jack sleeves 24. Jack screws 18 are welded to jack platform 16. Nuts 22 are welded to jack sleeves 24. Through rotating jack sleeves 24, it is possible to extend and lower jack screw assembly 15. A clamp 26 is provided to attach the top of pier cap stabilizer 8 against the side of the building.

Figure 2:
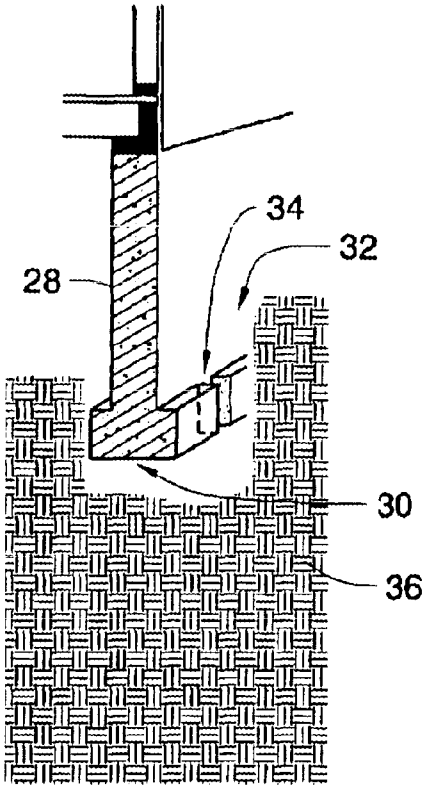
FIG. 2 depicts a preferred manner of preparing a structural footing to receive a pier shaft of a present embodiment of the invention.
Figure 5A:
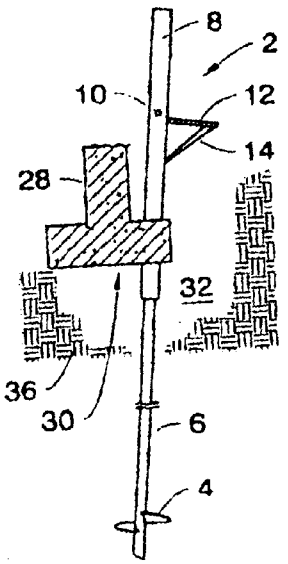
FIG. 5 depicts a preferred manner of installing a pier cap stabilizer on to a helical pier in accordance to a preferred present embodiment of the invention.
Figure 5B:
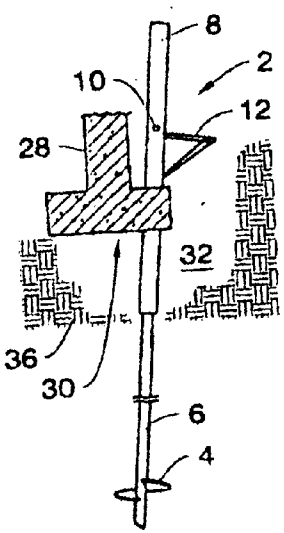
Figure 5C:
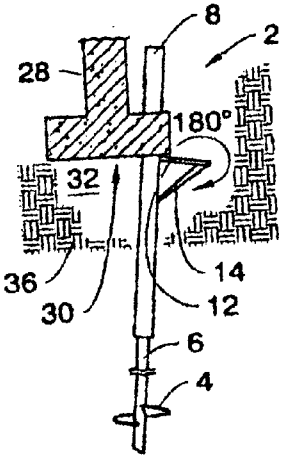
Figure 5D:
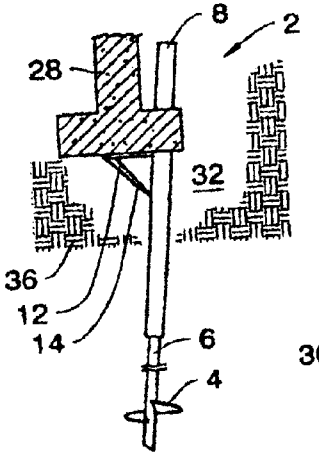
Figure 5E:
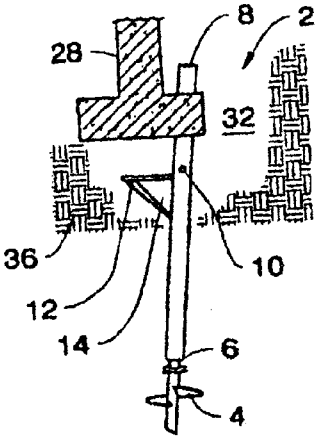

FIG. 2 depicts a preferred manner of preparing a structural footing 28 to receive pier shaft 6 of a present embodiment of the invention. Footing 28 has a bottom surface 30. An excavated area 32 is dug around footing 28 in order to install helical pier 2. A notch 34 is formed in footer 28 in order to guide and stabilize pier 6 as it is driven into earth 36. It is possible to form notch 34 in a variety of ways. One preferred method is through using a concrete saw. Alternatively, a concrete drill or a concrete chipping device could function to form notch 34. Other known ways of forming a notch in concrete can be used such as using a concrete core drill to form a hole. Note that excavated area 32 is dug around and below footer 28 to expose the bottom surface of footer 28.

Figure 3:
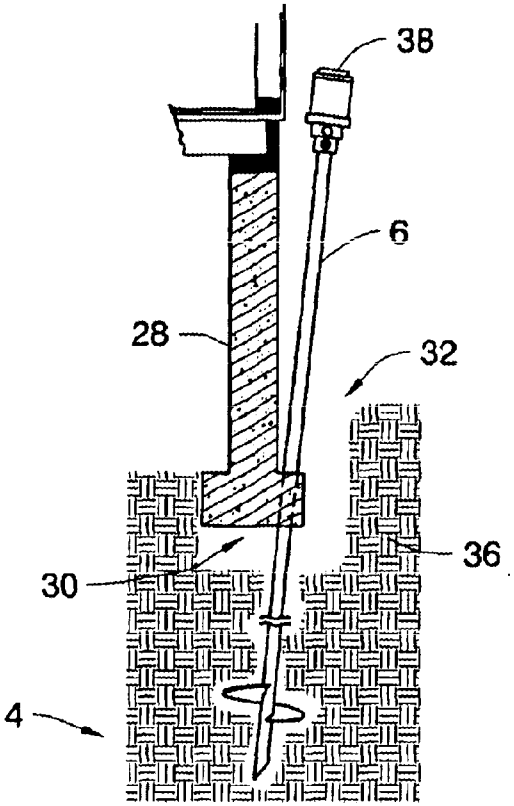
FIG. 3 depicts a preferred manner of installing a helical pier in accordance to a preferred present embodiment of the invention.

FIG. 3 depicts a preferred manner of installing helical pier 2 in accordance to a preferred present embodiment of the invention. Helical pier 2 is shown positioned in notch 34. Pier 6 is driven into earth 36 by torque motor 38. Through rotating helical pier 2 with motor 38, helix 4 screws its way down through earth 36 until the pier's 2 frictional resistance equals the compression weight of the structure. During this screw process, notch 34 serves to guide and stabilize pier 6 during the operation. Note that during this stage in the process of installing pier 2, only helix 6 and pier shaft 4 are involved. Note that in FIG. 3 it is necessary to install pier 2 at an angle in order to accommodate motor 38.

Figure 4:
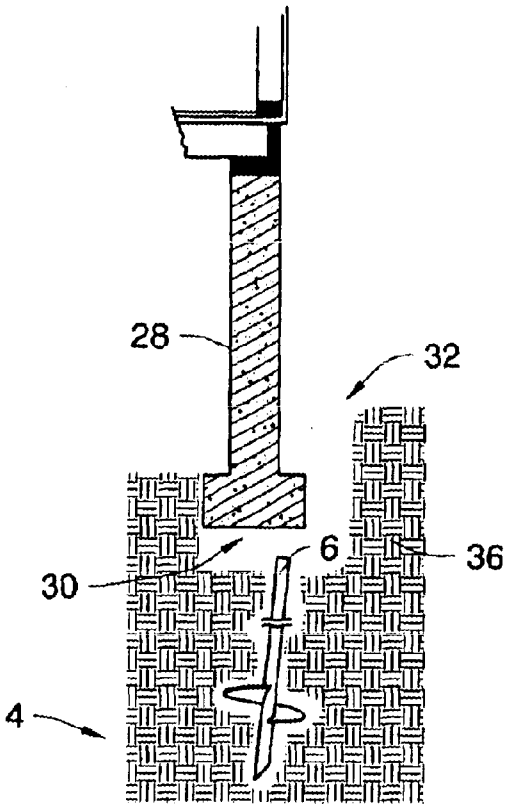
FIG. 4 depicts an installed pier shaft and helix assembly in accordance to a preferred present embodiment of the invention.

FIG. 4 depicts an installed pier shaft 4 and helix assembly 6 in accordance to a preferred present embodiment of the invention. Once helix 4 screws its way down through earth 36 until the pier's frictional resistance equals the compression weight of the structure, the top of pier shaft 6 is cut off below the bottom surface 30 of footer 28. At this stage, the installation of pier shaft 4 and helix assembly 6 is complete.

FIG. 5 depicts a preferred manner of installing a pier cap stabilizer 8 on to a helical pier 2 in accordance to a preferred present embodiment of the invention. In step (A), the pier cap stabilizer 8 is placed on top pier shaft 6. Pier cap stabilizer 8 is driven in step (B) down through earth 36 until bolt 10 comes into contact with the top of pier shaft 6. In step (C), pier cap stabilizer 8 is rotated 180 degrees until shelf 12 extends under bottom surface 30 of footer 28. Note that the shelf 12 is mounted at a slight angle with respect to pier cap stabilizer 8 in order to compensate for the slight angle that pier shaft 6 is driven into earth 6. This slight angle is provided in order to have shelf 12 parallel to bottom surface 30. Through having shelf 12 parallel to bottom surface 30, it is possible to place the load of footer 28 onto pier cap stabilizer 8.

In step (D), stabilizer pier cap 8 is shown in its final rotated position with shelf 12 extending under footer 28 in a parallel manner. Finally, pier cap stabilizer is driven further into earth 36 in order to create a space between footer 28 and shelf 12 so that it is possible to insert screw jack assembly 15 onto shelf 12.

Figure 6:
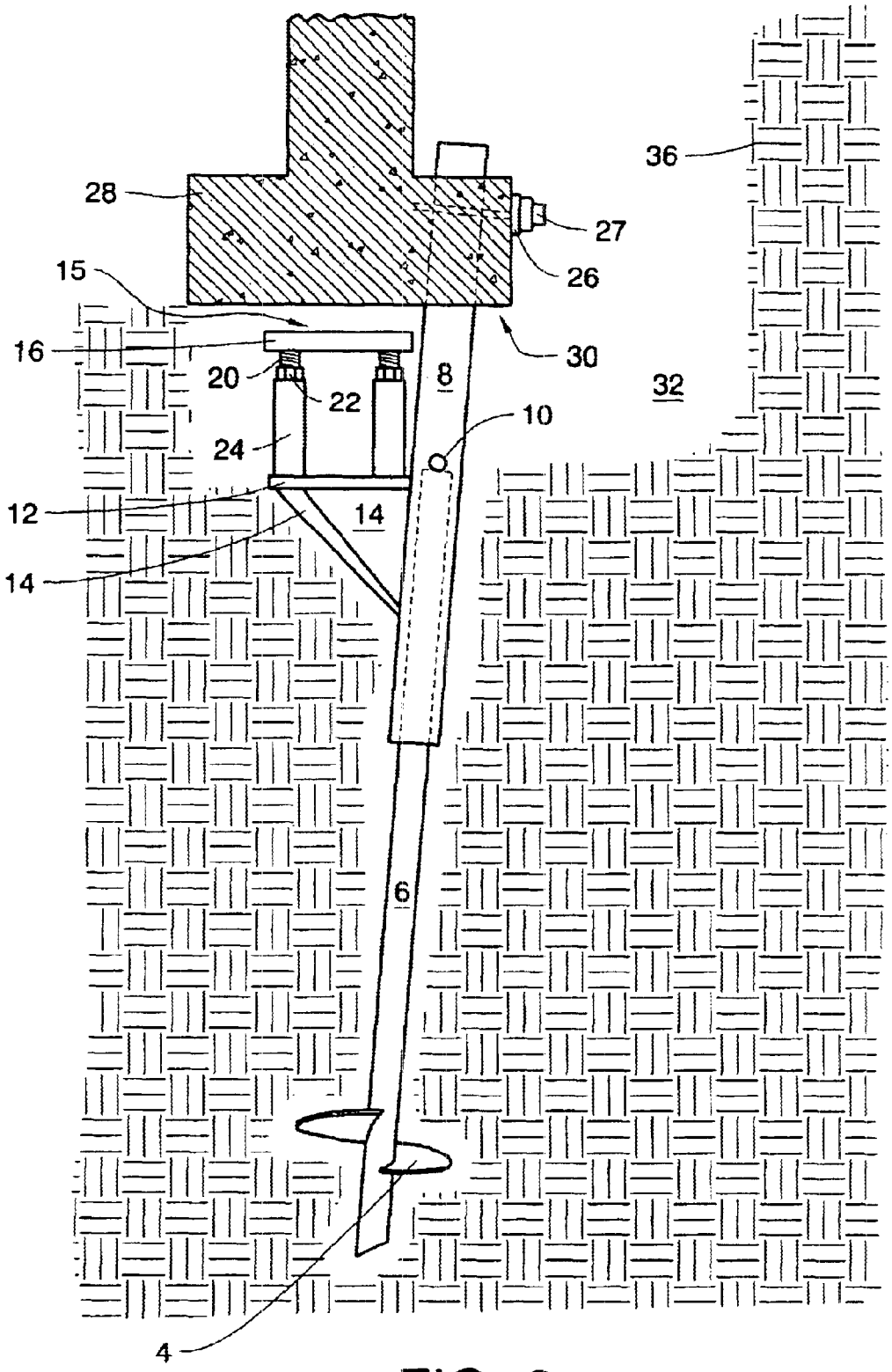
FIG. 6 depicts a preferred present embodiment of the invention in a preferred manner of installation where a jack screw is placed on a pier cap stabilizer.

FIG. 6 depicts a preferred present embodiment of the invention in a preferred manner of installation where a jack screw 15 is placed on a pier cap stabilizer 8. At this stage of installation, clamp 26 is fastened to footer 28 with one or more bolts 27. Clamp 26 functions to secure the top of pier cap stabilizer 8 to footer 28. Jack screw 15 is positioned such that jack platform 16 is at the top and threaded shafts 20 extend toward the bottom. The threaded shafts 20 rest upon shelf 12. Note that pier cap stabilizer 8 is driven down on pier shaft 6 such that bolt 10 rests upon the top surface of pier shaft 6.

Pier cap stabilizer 8 serves a variety of functions. First, it supports shelf 12 that is the resting platform for screw jack 15. Through having pier cap stabilizer 8 separate from pier shaft 6, the installation process is greatly simplified. Having pier cap stabilizer 8 enables pier shaft 6 to be installed without having a complex bracket assembly mounted to footer 28. Further, through having pier cap stabilizer 8 separate ensures that pier cap stabilizer 8 is not damaged while the pier shaft 6 is driven into the earth 36.

In addition, note in FIG. 6 that the pier shaft 6 overlaps pier cap stabilizer 8 for a region where gussets 14 mount to pier cap stabilizer 8. The position where gussets 14 are mounted to pier cap stabilizer 8 is a potential device failure point due to buckling. However, in the design of the present invention, the side-wall thickness of pier shaft 6 combines with the side-wall thickness of pier cap stabilizer 8 to reduce the possibility of buckling.

Figure 7:
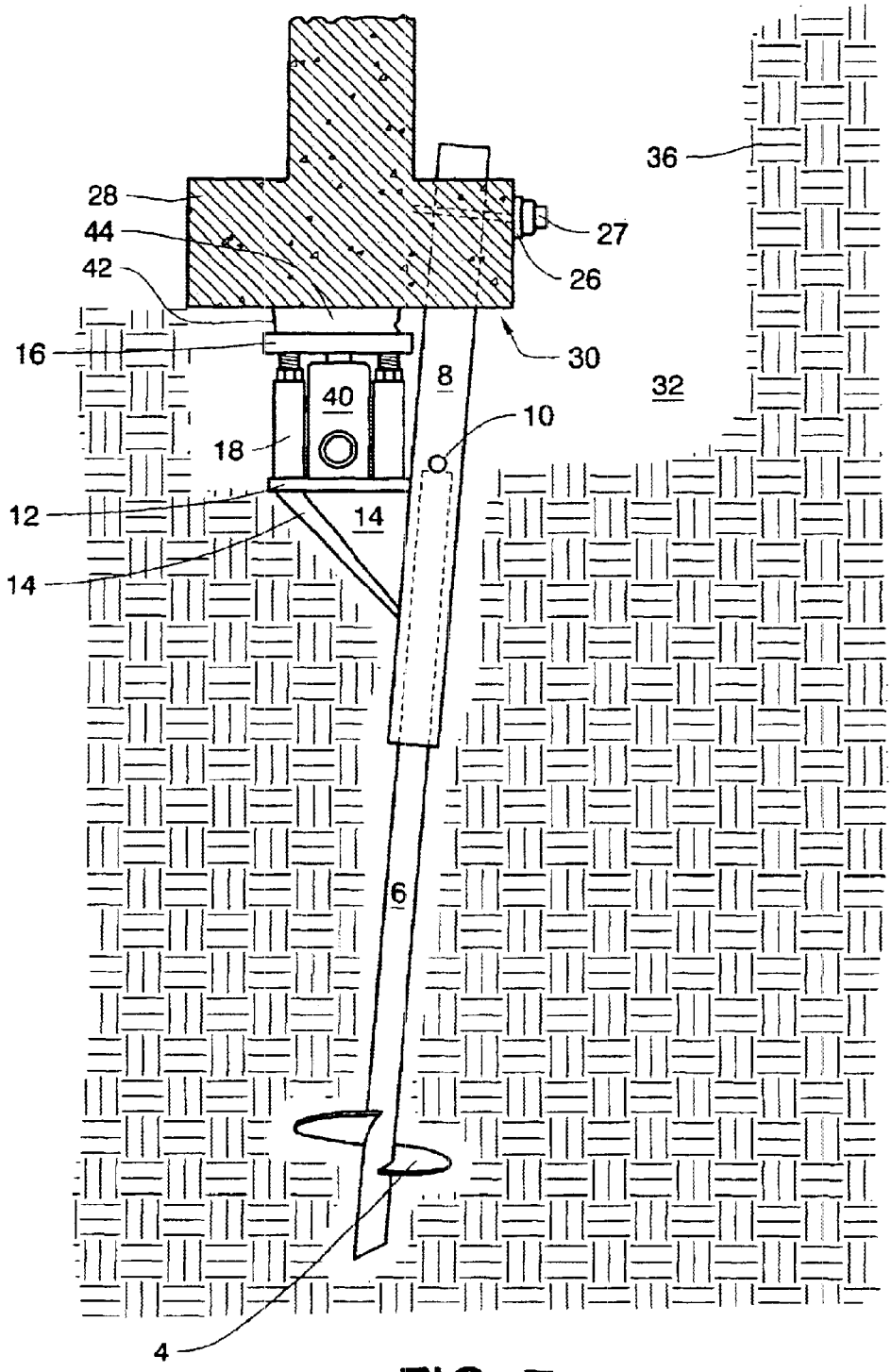
FIG. 7 depicts a preferred present embodiment of the invention in a preferred manner of installation where a hydraulic ram is placed under a jack screw in order to lift a footing of a structure vertically.
Figure 8:
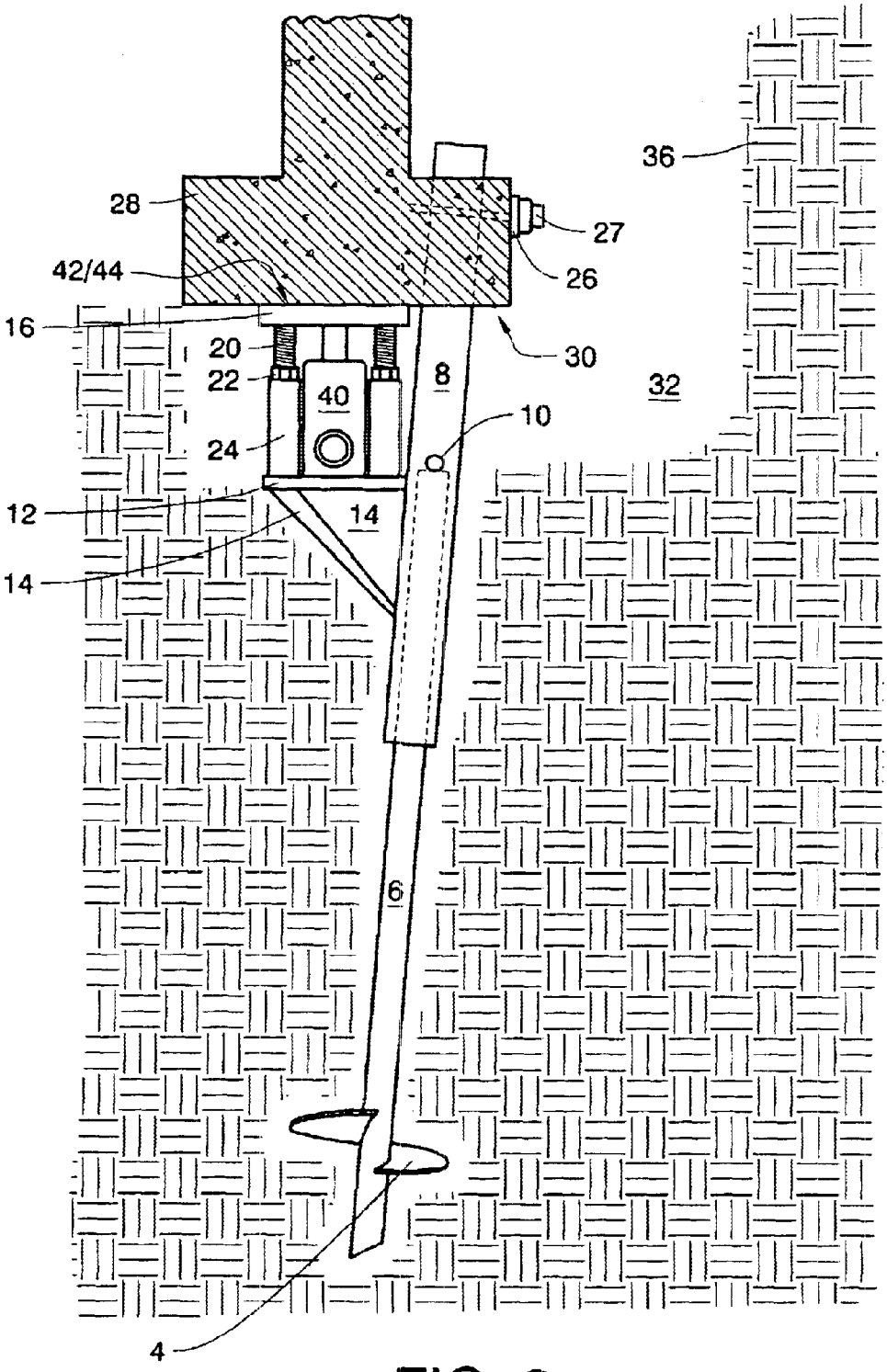
FIG. 8 depicts a preferred present embodiment of the invention in a preferred manner of installation where a hydraulic ram has completed lifting a footing of a structure vertically.

FIG. 7 depicts a preferred present embodiment of the invention a preferred manner of installation where a hydraulic ram 40 is placed under a jack screw 15 in order to lift footing 28 of the structure vertically. Settling and subsidence can lower the level of the footing 28 with respect to earth 36. Further, this settling can occur in an uneven manner causing parts of footing 28 to settle more than others. Piers 2 can remedy this problem by using hydraulic rams 40. Hydraulic rams 40 are placed on top of shelf 12 under jack platform 16. Hydraulic ram 40 pushes platform 16 up against bottom surface 30 of footing 28.

When platform 16 comes into contact with footing 28, hydraulic ram 40 pushes footing 28 upwards. The force of the house is transferred through shelf 12 and gussets 14 into the pier cap stabilizer 8, pier shaft 6, and finally helix 4.

Bottom surface 30, while shown flat, of building footer 28 is typically very rough. In order to create footer 28, construction workers typically dig a trench. Side-wall forms are placed along the sides of the trench to give the footer 28 its shape. The top surface of the footer 28 is smooth to receive the remainder of the building structure. However, the form that shapes the bottom surface 30 of the footer 28 is the bare ground. The concrete poured into the side-walls forming the footer 28 takes the shape of the ground's contours, the rocks, gravel, and dirt clods. Consequently, the bottom surface 30 of the footer 28 is typically very rough.

In order to attach helical pier 2 to bottom surface 30 of footer 28, it is necessary to prepare footer 28. To have a solid mechanical connection between the screw jack 15 and the bottom of footer 28, it is necessary to address the unevenness of bottom surface 30 of footer 28. Otherwise, if screw jack 15 is placed against uneven surface 30, stress fractures will occur in footing 28 damaging the structure and retarding the ability of helical pier 2 to support the building.

The present invention prepares footer 28 by inserting a flexible bag 42 filled with unhardened concrete 44 between the top surface of screw jack platform 16 and bottom surface 30 of footer 28. As jack screws 18 are turned until the required support contact is achieved between the pier cap stabilizer 8 and footing 28, bag 42 of unhardened concrete 44 is compressed between top plate 16 of screw jack 15 and bottom surface 30 of footer 28. Unhardened concrete 44 fills in the voids and contours on bottom surface 30 of footer 28 between footer 28 and top of the jack screw 16. When concrete 44 hardens, a flat surface is created between jack screw 15 and bottom 30 of footer 28. Consequently, this design reduces the presence of stress cracks at the position where footer 28 is supported by jack screw 15. Further, the use of bag 42 of unhardened concrete 44 is a very simple and cost effective means of preparing bottom surface 30 of footer 28. Consequently, the use of bag 42 greatly reduces the material and labor costs on installing helical pier 2.

Figure 9:
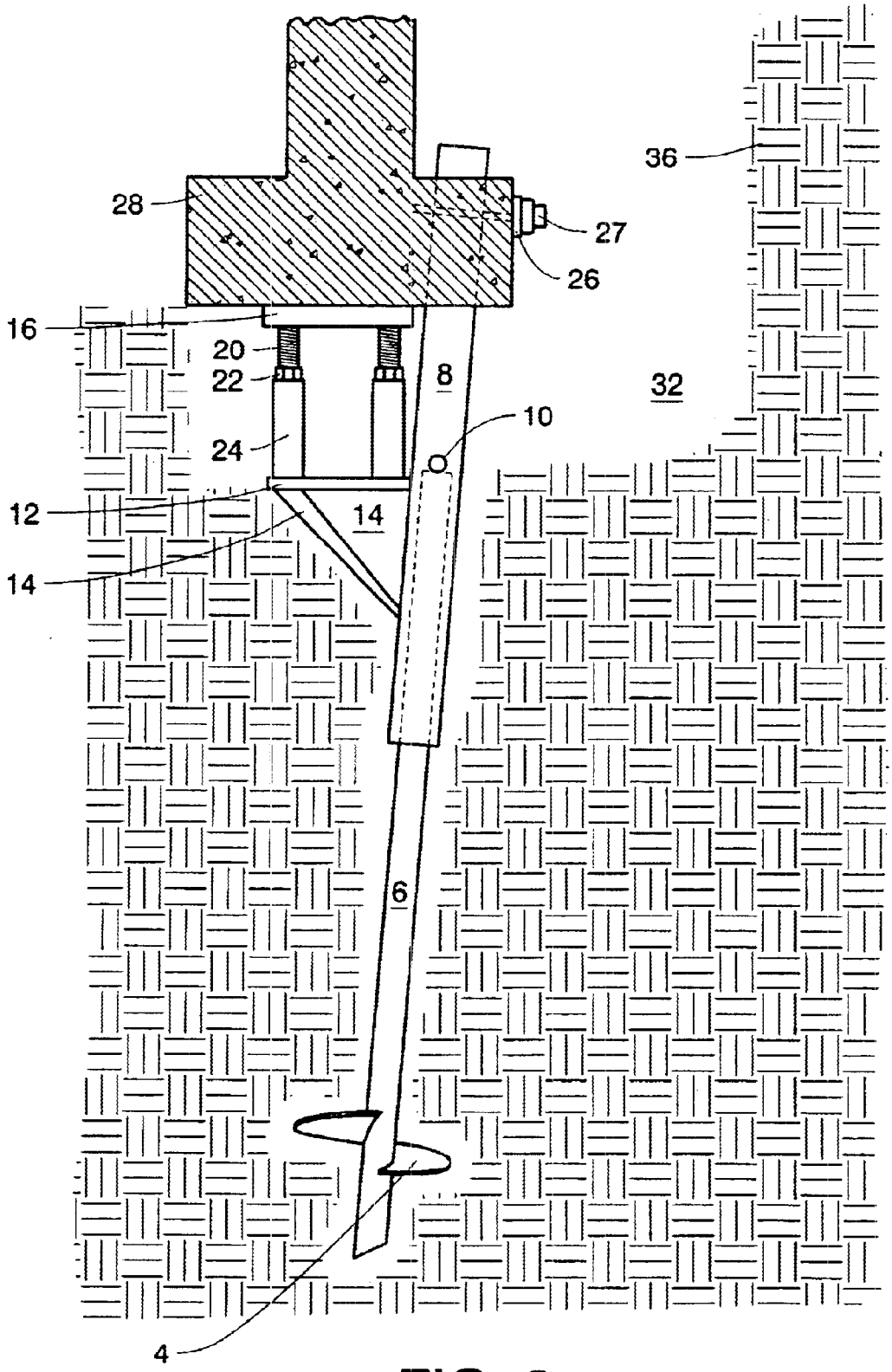
FIG. 9 depicts a preferred present embodiment of the invention in its final stage of installation.

FIG. 9 depicts a preferred present embodiment of the invention in its final stage of installation. In this figure, hydraulic ram 40 has completed lifting footer 28 to its final resting position. Note the changes in screw jack 15. Platform 16 is pressed firmly against bottom surface 30 of footer 28 with concrete 44 pressed firmly between. Jack sleeves 24 are rotated down until they firmly press against shelf 12. Note that now threaded shafts 20 are exposed. In this final stage of installation hydraulic ram 40 is removed from pier 2. Earth 36 is then filled in around the hole excavated to install pier 2. With the filling of earth 36, the installation of pier 2 is complete.

Figure 10:
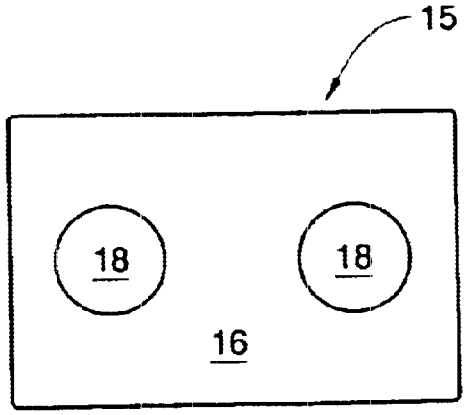
FIG. 10 depicts a preferred screw jack configuration of a preferred present embodiment of the invention.

FIG. 10 depicts a preferred screw jack configuration of a preferred present embodiment of the invention. In a preferred embodiment, two jack screws 18, formed of a threaded shaft 20, nut 22, and jack sleeve 24 are used for jack screw 15.

Figure 11:
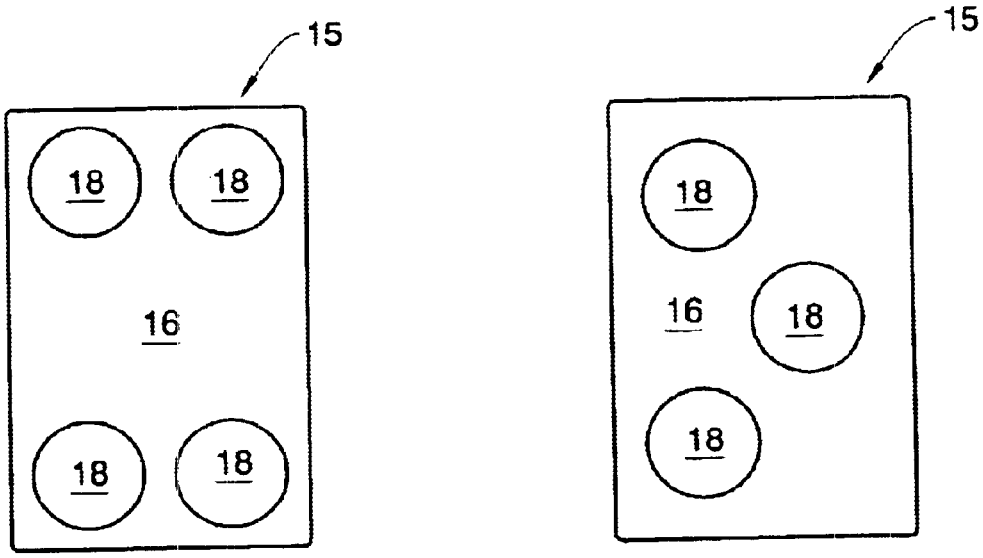
FIG. 11 depicts an alternative screw jack configuration of a preferred present embodiment of the invention.

FIG. 11 depicts two alternative screw jack configurations of a preferred present embodiment of the invention. In alternative embodiment, configurations of three or four jack screws 18 are used to form jack screw 15.

DETAILED DESCRIPTION OF AN ALTERNATIVE EMBODIMENT

Figure 12:
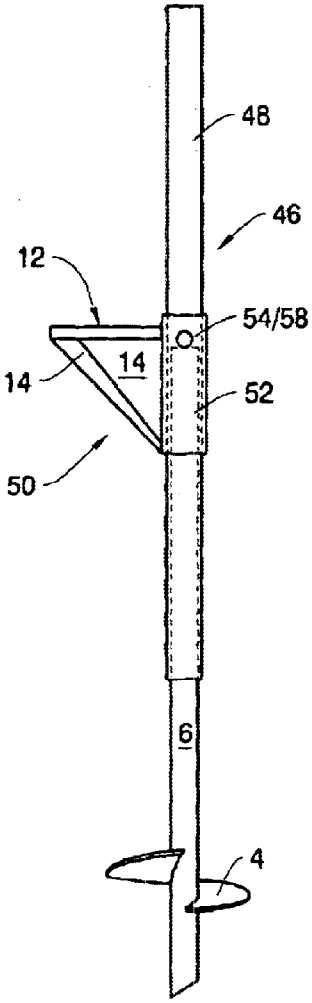
FIG. 12 depicts an alternative embodiment of the present invention.

FIG. 12 depicts an alternative embodiment of the present invention. The preferred embodiment of the invention has a single piece pier cap stabilizer 8. The alternative embodiment has a two piece pier cap stabilizer assembly 46. Two piece pier cap stabilizer assembly 46 is comprised of a vertical stabilizer 48 and a shelf structure 50. Shelf structure 50 is comprised of a shelf 12, a tube 52, and three gussets 14. Tube 52 has a hole 54 drilled through it to allow the insertion of bolt 56. Vertical stabilizer 48 has a hole 58 drilled through it to also allow the insertion of bolt 56.

Figure 13:
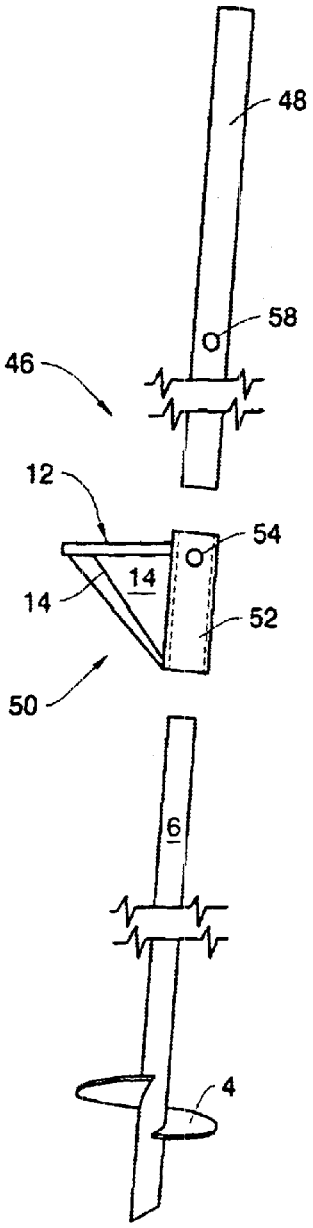
FIG. 13 depicts a disassembled view of an alternative embodiment of the present invention.

FIG. 13 depicts a disassembled view of an alternative embodiment of the present invention. In this figure are the three basic components of the alternative embodiment of the present invention. The three components are the vertical stabilizer 48, the shelf structure 50, and the pier shaft 6 and helix 4.

Figure 14:
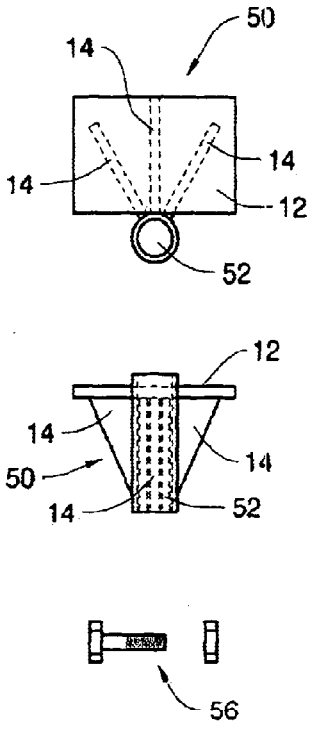
FIG. 14 depicts side and top views of shelf structure of an alternative embodiment of the invention.

FIG. 14 depicts side and top views of shelf structure 50 having shelf 12, tube 52, and three gussets 14. Tube 52 has hole 54 drilled through it to allow the insertion of bolt 56.

Figure 15:
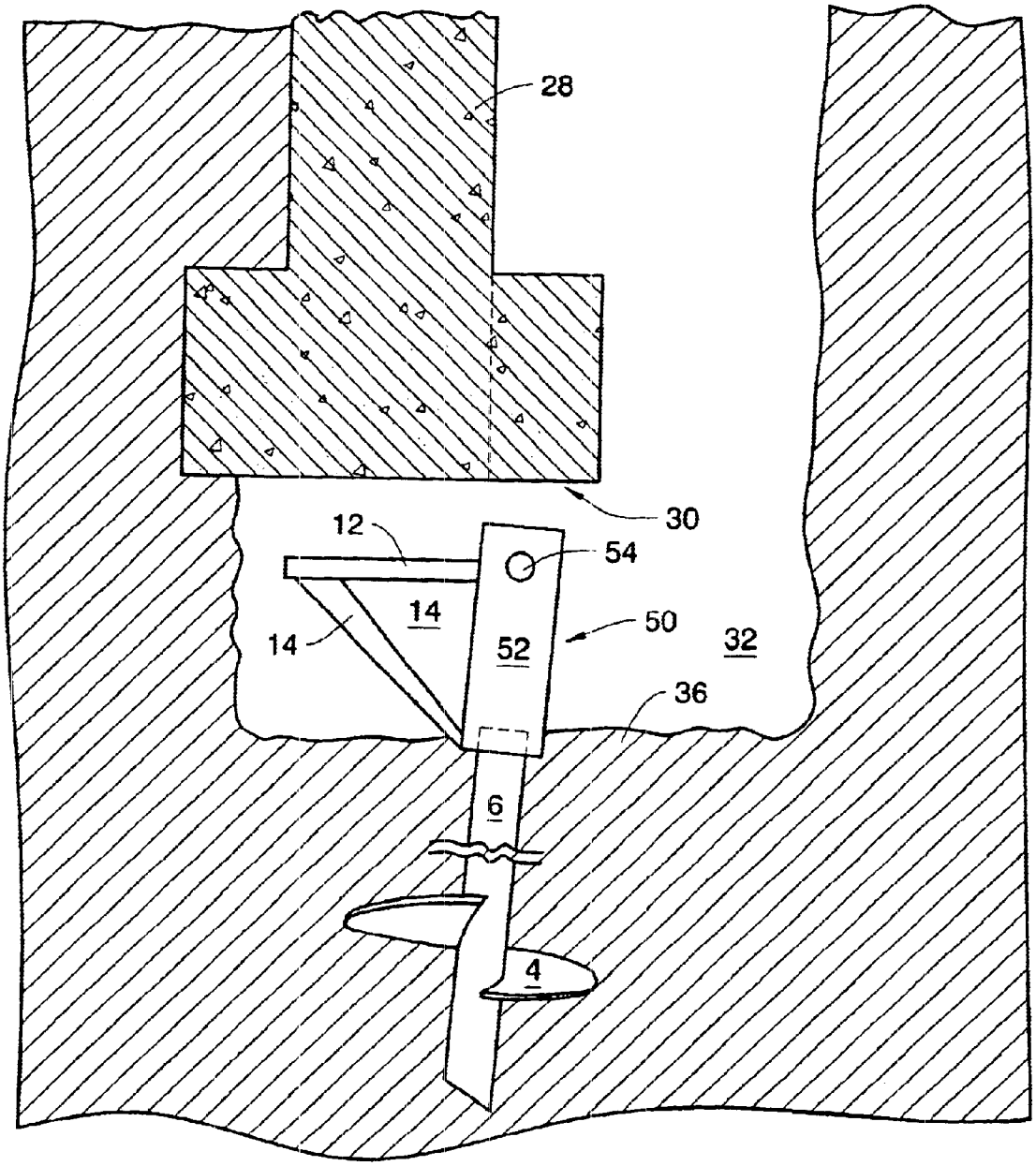
FIG. 15 depicts an alternative embodiment of the present invention at a stage of installation where a shelf structure is installed on a helical pier.

FIG. 15 depicts an alternative embodiment of the present invention at a stage of installation where shelf structure 50 is installed on pier shaft 6. At this stage of installation, pier shaft 6 and helix 4 have been driven to a depth where pier 6 reaches bedrock or until the pier's frictional resistance equals the compression weight of the structure. Pier shaft 6 is then cut off at the top just below footer 28. Separating shelf structure 50 from cap stabilizer assembly 46 eliminates the need to rotate shelf 12 into position under footer 28 as is required by a preferred embodiment of the present invention.

Figure 16:
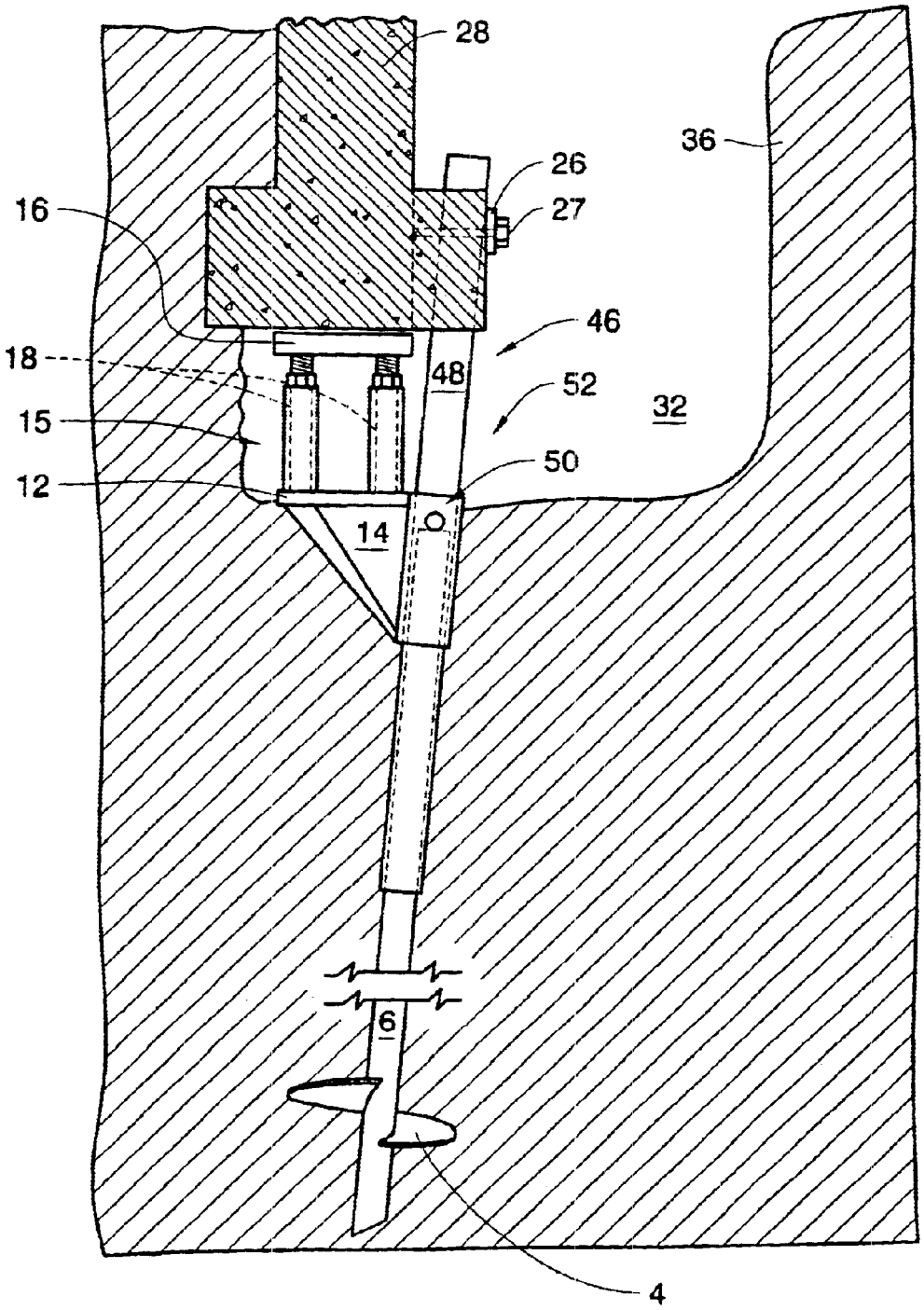
FIG. 16 depicts an alternative embodiment of the present invention at a final stage of installation.

FIG. 16 depicts an alternative embodiment of the present invention at a final stage of installation. The process for going from FIG. 15 to the final stage of installation requires that vertical stabilizer 48 be driven through tube 52 down over pier shaft 6 in order for holes 54 and 58 to align just above the top of pier shaft 6. Bolt 56 is then inserted through holes 54 and 58 and is then secured. From this stage on, the remaining installation processes for installing this alternative embodiment are identical to the process required to install a preferred embodiment described above.

Although the present invention has been described in detail, it will be apparent to those of skill in the art that the invention may be embodied in a variety of specific forms and that various changes, substitutions, and alterations can be made without departing from the spirit and scope of the invention. The described embodiments are only illustrative and not restrictive and the scope of the invention is, therefore, indicated by the following claims.

I claim:

1. A helical pier assembly for supporting a footer of a foundation, comprising:

a pier shaft having a bottom end and a top end;

a helix fixed to the bottom end of said pier shaft;

a pier cap stabilizer shaft mounted to the top end of said pier shaft, wherein a top portion of said pier cap stabilizer shaft extends above a bottom surface of said footer, wherein the top portion of said pier cap stabilizer shaft is mounted to said footer;

a shelf mounted on a side of said pier cap stabilizer shaft that extends horizontally under said footer; and a screw jack positioned on a top surface of said shelf that adjustably extends between said shelf and the bottom surface of said footer.

2. The helical pier assembly of claim 1, further comprising a flexible bag filled with an unhardened structural material, said flexible bag positioned on top of said screw jack.

3. The helical pier assembly of claim 2, wherein said unhardened structural material is unhardened concrete.

4. The helical pier assembly of claim 3 further comprising gussets mounted to said shelf and said pier cap stabilizer.

5. The helical pier assembly of claim 4, wherein said screw jack is comprised of:

a jack platform; and a jack screw.

6. The helical pier assembly of claim 5, further comprising a pin mounted to said stabilizer, said pin extends through said pier cap stabilizer across the top of said pier shaft.

7. The helical pier assembly of claim 6, wherein said pier cap stabilizer is comprised of:

a vertical stabilizer mounted on the top of said pier shaft; and a shelf structure mounted to said vertical stabilizer and said pier shaft.

8. The helical pier assembly of claim 2, further comprising:

a clamp that mounts the top portion of said pier cap stabilizer shaft that extends above the bottom surface of said footer to said footer; and a bolt that extends through said clamp into said footer.

9. The helical pier assembly of claim 8, further comprising a notch formed in said footing, said pier shaft rests in said notch.

10. A pier for supporting a footing, comprising:

a pier shaft;

a pier cap stabilizer shaft coupled to the top end of said pier shaft, wherein said pier cap stabilizer shaft has a top portion that extends above a bottom surface of said footing;

a shelf structure coupled to a side of said pier cap stabilizer shaft such that it extends horizontally under said footing;

a screw jack positioned on a top surface of said shelf that adjustably extends between said shelf and the bottom surface of said footing; and a bolt that couples said footing to the top portion of said pier cap stabilizer shaft that extends above the bottom surface of said footing.

11. The pier assembly of claim 10, further comprising a flexible bag filled with an unhardened structural material, said flexible bag positioned on top of said screw jack below the bottom surface of said footing.

12. The pier assembly of claim 10, further comprising a clamp mounting the top portion of said pier cap stabilizer shaft that extends above the bottom surface of said footing to said footing, wherein said bolt passes through said clamp into said footing.

13. The pier assembly of claim 10, wherein said pier shaft is positioned within a notch formed in said footing.

14. The pier assembly of claim 10, wherein said pier cap stabilizer shaft rotates with respect to said pier shaft, wherein said shelf structure extends away from said footer when said pier cap stabilizer shaft is coupled to said pier shaft, wherein rotation of said pier cap stabilizer shaft places said shelf structure in a position such that it extends horizontally under said footing.

15. The pier assembly of claim 14, wherein said pier shaft is positioned at an angle with respect to said footing.

16. The pier assembly of claim 10, wherein said shelf structure is rotatably coupled to said pier cap stabilizer shaft, wherein rotation of said shelf structure places said shelf structure in a position such that it extends horizontally under said footing.

17. The pier assembly of claim 10, wherein said shelf structure is mounted to a tube, wherein said tube slides over said pier cap stabilizer shaft.

18. The pier assembly of claim 10, further comprising a bolt that rigidly secures said tube to said pier cap stabilizer shaft.

19. A pier assembly for supporting a footer of a foundation, comprising:

a pier;

a pier cap stabilizer coupled to said pier that forms a sleeve that extends over a top portion of said pier, thereby providing mechanical support to said pier, wherein said pier cap stabilizer rotates axially with respect to said pier;

a shelf mounted to a side of said pier cap stabilizer, wherein said shelf extends away out from under said footer when said pier cap stabilizer is placed over said pier, wherein rotating said pier cap stabilizer with respect to said pier places said shelf under said footer; and a screw jack assembly positioned on a top surface of said shelf that adjustably extends between said shelf and a bottom surface of said footer a flexible bag containing unhardened structural material placed between said shelf and said footer.

20. The pier assembly of claim 19, further comprising a clamp mounting said footing to a top portion of said pier cap stabilizer that extends above a bottom surface of said footing.

21. The pier assembly of claim 19, wherein said pier cap stabilizer slides over the top portion of said pier shaft.

22. The pier of 19, further comprising a bolt that extends through said pier cap stabilizer across the top portion of said pier shaft, thereby locking said pier cap stabilizer in a fixed vertical position with respect to said pier.

23. The pier of claim 19, wherein said pier is positioned at an angle with respect to said footer.

* * * * *